United States Patent [19]

Kinder et al.

[11] Patent Number: 5,061,160

[45] Date of Patent: Oct. 29, 1991

[54] TWO-SPEED GEROTOR WITH SPOOL VALVE CONTROLLING WORKING FLUID

[75] Inventors: Mark R. Kinder, Indianapolis; Glenn R. Wert, Monticello, both of Ind.

[73] Assignee: TRW Inc., Lyndhurst, Ohio

[21] Appl. No.: 495,446

[22] Filed: Mar. 14, 1990

[51] Int. Cl.[5] ..... F01C 1/02; F03C 3/00

[52] U.S. Cl. ..... 418/61.3; 137/625.69

[58] Field of Search ..... 418/61.3, 209; 137/625.69

[56] References Cited

U.S. PATENT DOCUMENTS

| | | | |
|---|---|---|---|
| 3,616,882 | 11/1971 | White | 418/61.3 |
| 3,778,198 | 12/1973 | Giversen | 418/61.3 |
| 3,892,503 | 7/1975 | Getman | 418/61.3 |
| 4,480,971 | 11/1984 | Swedberg | 418/61.3 |
| 4,715,798 | 12/1987 | Bernstrom | 418/61.3 |
| 4,767,292 | 8/1988 | Kinder | 418/61.3 |

*Primary Examiner*—Richard A. Bertsch
*Assistant Examiner*—David L. Cavanaugh
*Attorney, Agent, or Firm*—Tarolli, Sundheim & Covell

[57] ABSTRACT

A fluid motor includes an inner gear member and an outer gear member. The gear members are rotatable and orbital relative to each other and define expandable and contractible fluid pockets. The gear members rotate and orbit relative to each other as the fluid pockets expand and contract. A commutator valve is movable with one of the gear members and defines a first region in communication with high pressure, a second region in communication with low pressure, and a third region which is defined by a modulation opening which selectively communicates with high pressure or low pressure. The modulation opening communicates with at least one fluid pocket. A spool valve includes a valve member having at least two positions for controlling the speed of relative movement between the gear members. When the valve member is in a first position, the modulation opening communicates with the low pressure in the second region. When the valve member is in a second position, the modulation opening communicates with the high pressure in the first region. The fluid pocket communicating with the modulation opening is thereby connected to either high pressure or low pressure depending upon the position of the valve member.

10 Claims, 5 Drawing Sheets

TWO-SPEED GEROTOR WITH SPOOL VALVE CONTROLLING WORKING FLUID

BACKGROUND OF THE INVENTION

1. Technical Field

The present invention relates to a two-speed fluid motor having expandable and contractible fluid pockets formed by a gerotor gearset which includes relatively rotatable and orbital inner and outer gear members having teeth which define the fluid pockets.

2. Background Art

A two-speed fluid motor having expandable and contractible fluid pockets formed by a gerotor gearset is disclosed in U.S. Pat. No. 3,778,198. The gerotor gearset includes a stator member having internal teeth and a rotor member having external teeth. The number of teeth on the rotor member is one less than the number of teeth on the stator member. The rotor member is eccentrically disposed within the stator member and is rotatable and orbital relative to the stator member. The rotor member is supported and guided in its rotating and orbiting movement by the teeth of the stator member. The teeth of the rotor member and the teeth of the stator member define the expandable and contractible fluid pockets.

The motor has a fluid inlet port and a fluid outlet port. A commutator valve directs fluid from the inlet port to certain of the fluid pockets and from other of the fluid pockets to the outlet port. The fluid pressure in the fluid pockets causes the rotor member to rotate and orbit relative to the stator member. The output shaft of the motor is driven by the rotor member.

A spool valve is located upstream of the commutator valve and is movable between two positions. In one position, the spool valve directs inlet fluid flow to the commutator valve, and the commutator valve directs the inlet fluid flow to a certain number of the fluid pockets. In the other position of the spool valve, inlet fluid flow is directed to a lesser number of fluid pockets. When inlet fluid flow is directed to the certain number of fluid pockets, the motor operates in a low speed, high torque mode. In the other position of the spool valve, the motor operates in a high speed, low torque mode.

Another two-speed hydraulic motor with expandable and contractible fluid pockets formed by a gerotor gearset is disclosed in U.S. Pat. No. 4,480,971. As disclosed in U.S. Pat. No. 4,480,971, a commutator valve directs fluid flow to and from the fluid pockets. A switching valve located upstream of the commutator valve is movable between two positions. In one position of the switching valve, four fluid pockets communicate with an inlet port and the motor operates in a low speed, high torque mode. In the other position of the switching valve, only two fluid pockets communicate with the inlet port and the motor operates in a high speed, low torque mode.

SUMMARY OF THE INVENTION

The present invention is directed to a fluid, preferably hydraulic, motor which includes a gerotor gearset. The gerotor gearset includes an inner gear member having external teeth and an outer gear member having internal teeth. The gear members are rotatable and orbital relative to each other, and the teeth of the gear members define expandable and contractible fluid pockets. The gear members rotate and orbit relative to each other as the fluid pockets expand and contract. A commutator valve is movable with one of the gear members. The commutator valve defines a first fluid region in communication with high pressure, a second fluid region in communication with low pressure and a third fluid region, preferably a modulation opening in the commutator valve, which selectively communicates with high pressure or low pressure. Means is provided for (i) communicating high pressure from the first fluid region to a certain number of the fluid pockets, (ii) communicating low pressure from the second fluid region to other of the fluid pockets, and (iii) communicating at least one fluid pocket with the third fluid region.

Valve means is provided for controling the speed of relative movement between the gear members. The valve means preferably includes a spool valve member having a first position in which the third fluid region communicates with the low pressure from the second fluid region and a second position in which the third fluid region communicates with the high pressure from the first fluid region.

Preferably, the fluid motor includes a first fluid passage connected in fluid communication with the high pressure in the first fluid region, a second fluid passage connected in fluid communication with the low pressure in the second fluid region, and a third fluid passage connected in fluid communication with the third fluid region, namely the modulation opening in the commutator valve which is in fluid communication with at least one fluid pocket. The third fluid passage is selectively connected in fluid communication by the spool valve member with the first fluid passage or the second fluid passage.

When the spool valve member is in its first position, the second and third passages are connected in fluid communication with each other. Low pressure in the second fluid region is thereby communicated to the modulation opening of the commutator valve and to at least one fluid pocket which is in communication with the modulation opening. When the spool valve is in its second position, the first and third passages are connected in fluid communication with each other. High pressure in the first fluid region is thereby communicated to the modulation opening and to at least one fluid pocket which is in communication with the modulation opening, as well as to the certain number of the fluid pockets. Thus, the third fluid region, i.e. the modulation opening, is selectively connected with either high pressure or low pressure, and the number of fluid pockets communicating with high pressure depends upon whether the modulation opening is connected with high pressure or low pressure.

Typically, a fixed displacement pump supplies pressurized fluid to the motor. Therefore, the rate of fluid flow through the motor is constant. When the spool valve member is in its first position, a predetermined amount of pressurized fluid flows from the pump to the certain number of fluid pockets. The motor operates at a relatively high speed and delivers a relatively low torque output. When the spool valve is in its second position, the pressurized fluid flows through the motor at the same constant rate, but flows through a greater number of fluid pockets, i.e. to the certain number of fluid pockets and to the at least one fluid pocket. Thus, the motor operates at a relatively low speed and delivers a relatively high torque output.

BRIEF DESCRIPTION OF THE DRAWINGS

The foregoing and other features and advantages of the present invention will become apparent to one skilled in the art to which the present invention relates from reading the following description of a preferred embodiment of the present invention in conjunction with the accompanying drawings, wherein.

DETAILED DESCRIPTION OF A PREFERRED EMBODIMENT

Figure 1:
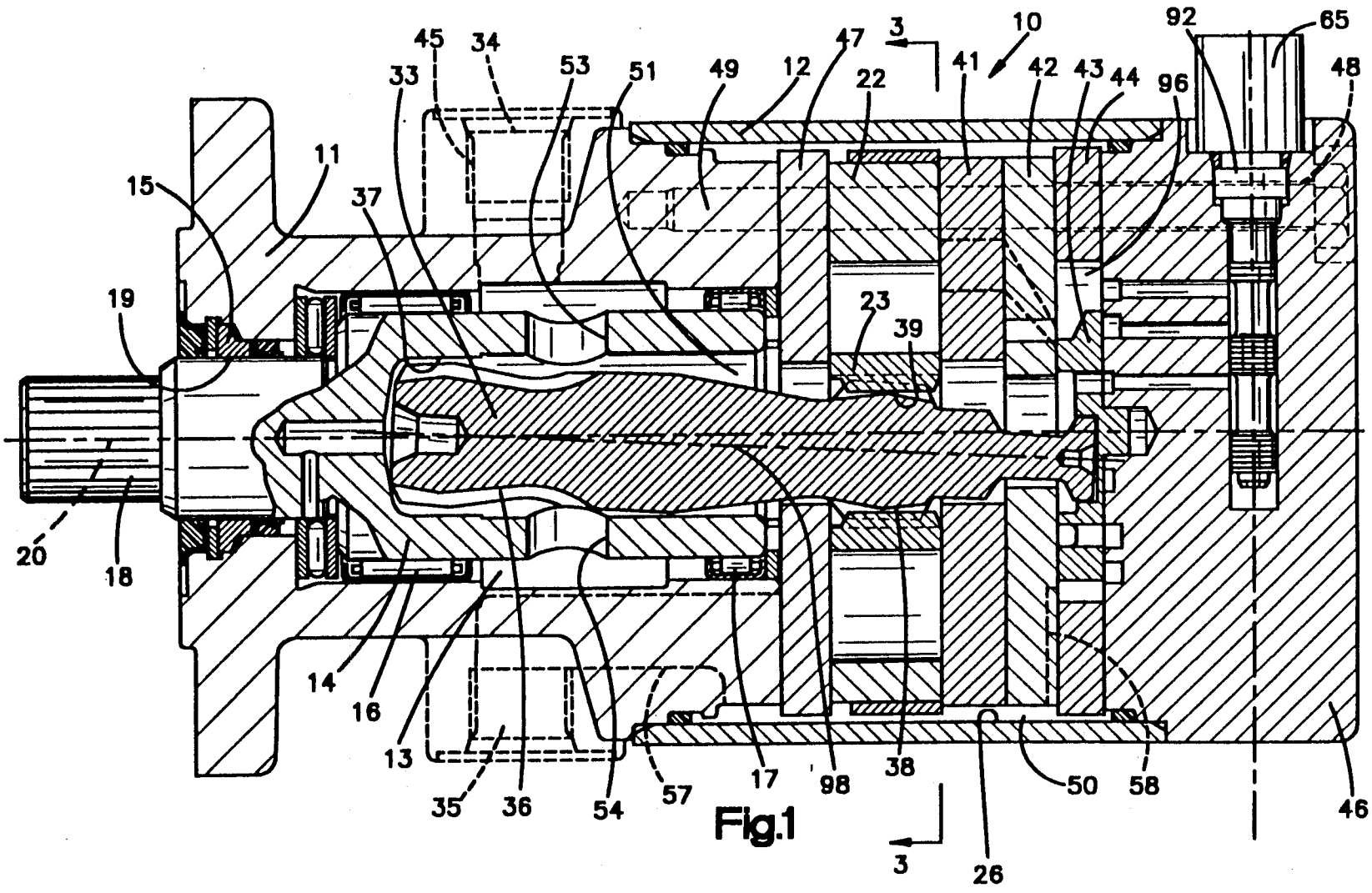
FIG. 1 is a longitudinal sectional view of a motor constructed in accordance with the present invention.

The present invention relates to a fluid motor having fluid pockets formed by a gerotor gearset. The specific use and construction of the motor may vary. By way of example, the present invention is illustrated in the drawings as embodied in a hydraulic motor 10.

The hydraulic motor 10 includes a body 11. An axial fluid chamber 13 is formed within the body 11. An output shaft 18 includes a tubular drive sleeve 14 housed within the fluid chamber 13. The drive sleeve 14 is journalled for rotation relative to the body 11 by a pair of bearing members 16, 17 spaced axially along the length of the drive sleeve 14. The output shaft 18 extends through an opening 19 of the body 11. Suitable bearing and seal members 15 are disposed between a portion of the output shaft 18 and a portion of the body 11 adjacent the opening 19. The axis of rotation of the output shaft 18 is represented by the dashed line 20. The output shaft 18 is connectable by suitable means to a member (not shown) to be driven by the hydraulic motor 10.

Figure 3:
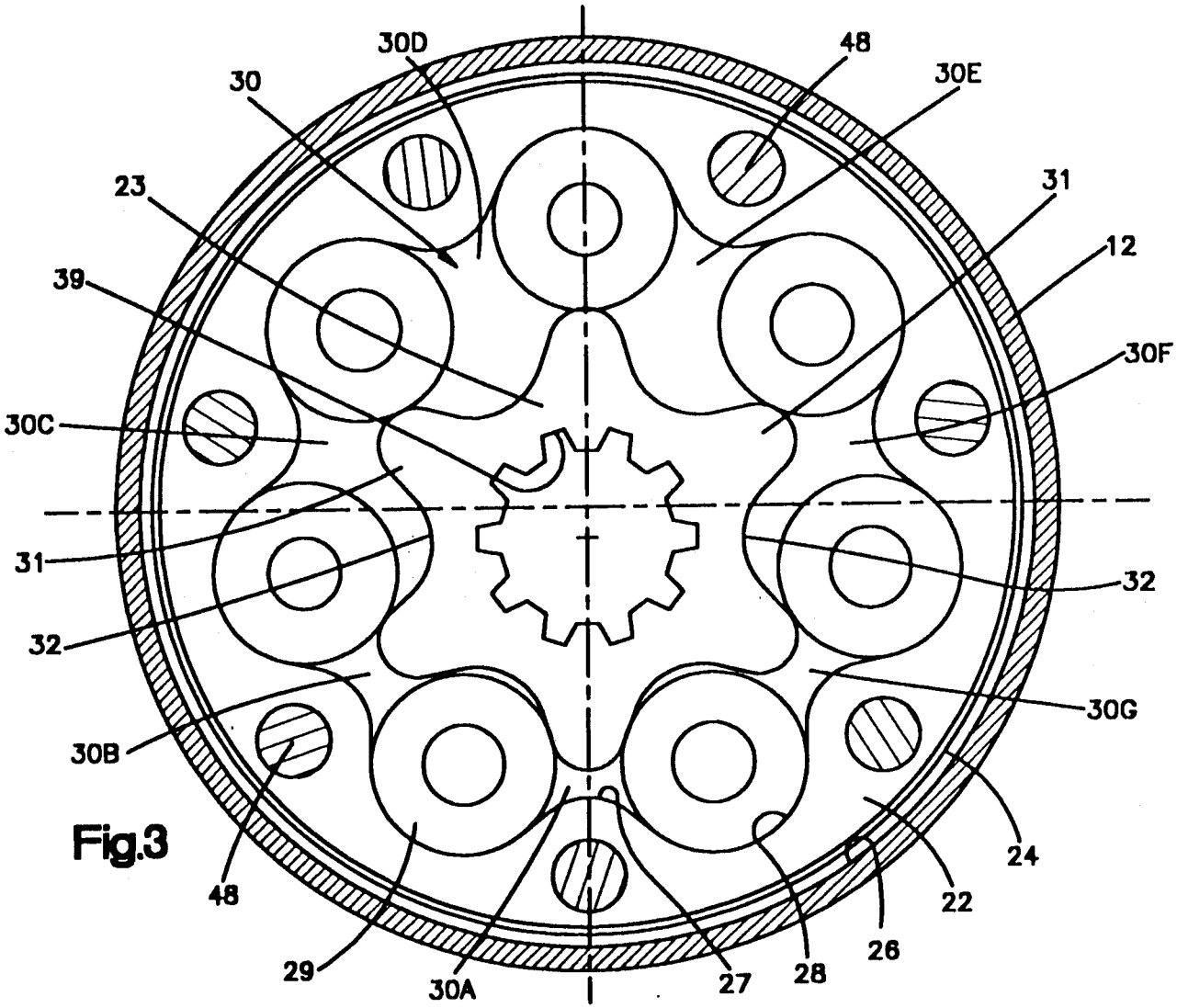
FIG. 3 is a view, taken approximately along the line 3—3, of FIG. 1.

Referring to FIGS. 1 and 3, a gerotor gearset is housed within a tubular casing 12. The gerotor gearset includes a stator member 22 having internal teeth and a rotor member 23 having external teeth. The teeth of the stator member 22 and the teeth of the rotor member 23 cooperate to define expandable and contractible fluid pockets. The axis of the rotor member 23 is offset with respect to the axis of the stator member 22 such that movement of the rotor member 23 relative to the stator member 22 is essentially hypocycloidal, ie., possessing both rotational and orbital components, as is known. It will be understood to one skilled in the art that the stator member could be rotatable and orbital relative to the rotor member. Further, it is conceivable that the rotor member could rotate relative to the stator member while the stator member could orbit relative to the rotor member, or vice versa.

The stator member 22 has an outer circumferential surface 24 spaced radially inwardly of an inner circumferential surface 26 of the tubular casing 12. The stator member 22 is centrally apertured to provide an inner circumferential surface 27 which defines, in circumferentially spaced relation, a series of axially extending recesses 28. The recesses 28 house cylindrical vane members 29 which form the internal teeth of the stator member 22, as is known. The rotor member 23 has a plurality of external teeth 31 which in number equal one less than the number of internal teeth 29 of the stator member 22. The rotor member 23 has outer circumferential surface portions 32 interconnecting adjacent teeth 31.

A series of fluid pockets 30 are defined between the internal teeth 29 of the stator member 22. The fluid pockets 30 are individually designated as 30A, 30B, 30C, 30D, 30E, 30F, and 30G. Each of the fluid pockets 30 expands and contracts as the rotor member 23 rotates and orbits relative to the stator member 22.

A wobble shaft 33 drivingly interconnects the rotor member 23 with the drive sleeve 14. The axis of rotation of the wobble shaft 33 is represented by the dashed line 98 and is disposed at an angle to the axis 20 of the shaft 18. The wobble shaft 33 is splined along a portion 36. The portion 36 is received in a splined bore 37 of the drive sleeve 14. The wobble shaft 33 is also splined along a portion 38. The portion 38 is received in a splined bore 39 of the rotor member 23. The wobble shaft 33 rotates with the rotor member 23 and drives the sleeve 14. The splines at both portions 36, 38 on the wobble shaft 33 permit limited pivotal movement of the wobble shaft 33 relative to the drive sleeve 14 and the rotor member 23.

Figure 2:
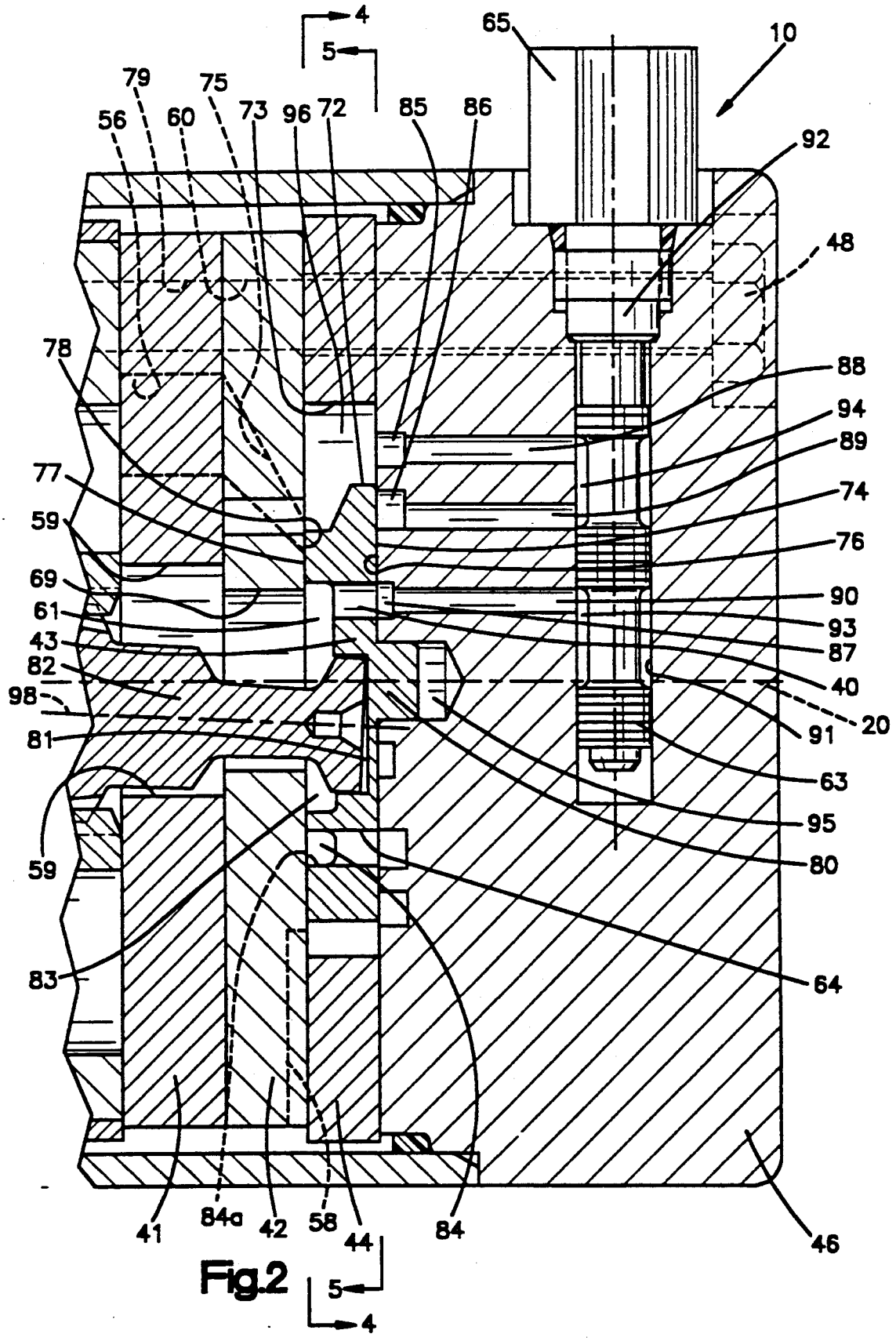
FIG. 2 is an enlarged view of a portion of FIG. 1.

Referring to FIGS. 1-3, the hydraulic motor 10 further includes a first manifold plate 41 and a second manifold plate 42. Each of the manifold plates 41, 42 is stationary relative to the stator member 22. The first manifold plate 41 is located between the second manifold plate 42 and one axial side of the stator member 22 and the rotor member 23. A wear plate 47 is located at the other axial side of the stator member 22 and the rotor member 23. A plate 44 is located between an end plate 46 and the second manifold plate 42. Each of the plates 41, 42, 44, 47 is circular and has a diameter approximately equal to the diameter of the outer circumferential surface 24 of the stator member 22. A plurality of threaded bolts 48 extend through aligned openings formed in each of the plates 41, 42, 44, 46, 47. The bolts 48 are screwed into the body 11 at location 49 and clamp the various parts together.

The first and second manifold plates 41, 42 are located adjacent to each other. The construction of the first and second manifold plates 41, 42 is known. More specifically, the details of construction of the first and second manifold plates 41, 42 is fully described in U.S Pat. No. 3,616,882, assigned to TRW Inc. and entitled "Hydraulic Motor-Pump Assembly With Built-In Brake".

Referring to FIGS. 2 and 3, the first manifold plate 41 has a series of circumferentially spaced axial openings 79 formed therein to receive the bolts 48. The first manifold plate 41 has a plurality of fluid passages 56 (only one of which is shown schematically in FIG. 2) extending through the first manifold plate 41. The number of fluid passages 56 corresponds to the number of fluid pockets 30 formed between the internal teeth 29 of the stator member 22. Each of the fluid passages 56 is connected in fluid communication with a fluid pocket. The first manifold plate 41 also has a central opening 59 which receives the wobble shaft 33.

The second manifold plate 42 has a series of circumferentially spaced axial openings 60 formed therein to receive the bolts 48. A plurality of fluid passages 75 (only one of which is shown schematically in FIG. 2) are formed in the second manifold plate 42. The fluid passages 75 communicate with the fluid passages 56 as shown schematically in FIG. 2. The fluid passages 75 intersect an axial end face 78 of the second manifold plate 42 and form a number of generally oval-shaped openings 97 (see FIG. 5) in the axial end face 78 of the second manifold plate 42. The number of oval-shaped openings 97 equals the number of fluid pockets 30. Thus, each of the oval-shaped openings 97 communicates with a fluid pocket. The oval-shaped openings 97 are individually designated as 97A, 97B, 97C, 97D, 97E, 97F, and 97G and communicate with the fluid pockets 30A, 30B, 30C, 30D, 30E, 30F, and 30G, respectively.

An inlet port 34 located on one side of the body 11 is connectable in fluid communication to a source of high fluid pressure (not shown), preferably a fixed displacement pump. The inlet port 34 communicates through a radial fluid passage 45, the fluid chamber 13, and bores 53, 54 formed radially in the drive sleeve 14 to a fluid passage 51 formed between the radially inner surface of the drive sleeve 14 and the outer periphery of the wobble shaft 33. The fluid passage 51 is connected in fluid communication with a first fluid region 61 in the plate 44. Thus, the first fluid region 61 communicates with the high fluid pressure at the inlet port 34.

An outlet port 35 located on the opposite side of the body 11 is connectable in fluid communication to low fluid pressure (not shown). The outlet port 35 communicates through an axially extending fluid passage 57 in the body 11 to an axially extending fluid passage 50 defined between the radially inner circumferential surface 26 of the tubular casing 12 and the radially outer circumferential surfaces of plates 41, 42, 44, and 47. The fluid passage 50 communicates through a radially extending fluid passage 58 (shown schematically in FIGS. 1 and 2) in the second manifold plate 42 with a second fluid region 96 in the plate 44. Thus, the second fluid region 96 communicates with the low fluid pressure at the outlet port 35.

Referring to FIG. 2, the motor 10 includes a disc-shaped commutator valve 43 disposed within a central opening in the plate 44. The commutator valve 43 engages and is movable relative to the second manifold plate 42. A radially extending face 77 of the commutator valve 43 slidingly engages the axial end face 78 of the second manifold plate 42. The opposite radially extending face 74 of the commutator valve 43 slidingly engages a radially extending surface 76 of the end plate 46.

The commutator valve 43 also includes a circular recess 81 formed in the face 77. The circular recess 81 receives a nose portion 82 of the wobble shaft 33. The commutator valve 43 further includes a circular nose portion 80 extending axially away from the nose portion 82 of the wobble shaft 33 as shown in FIG. 2. The nose portion 80 of the commutator valve 43 is rotatably supported in a complementary-shaped recess 95 in the end plate 46. The axis 20 of the output shaft 18 extends through the center of the nose portion 80. As the wobble shaft 33 rotates about its axis 98 and orbit with the rotor 23 relative to the stator 22, the commutator valve 43 is rotated by the wobble shaft 33 about the axis 20.

Figure 5:
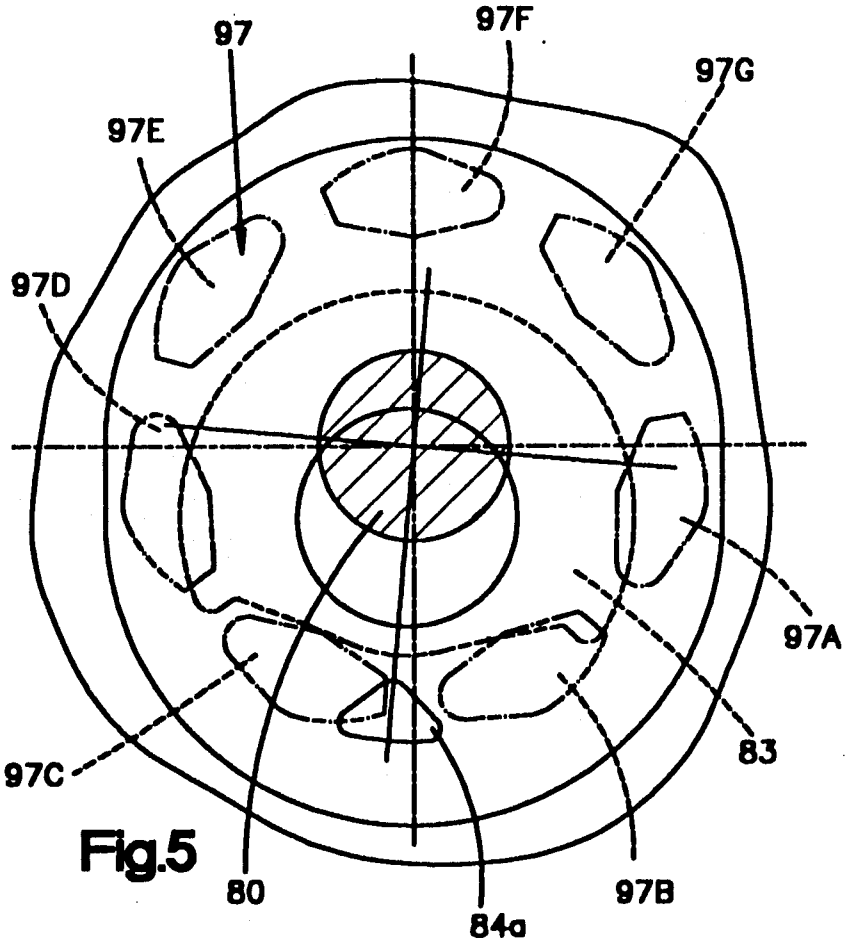
FIG. 5 is a partial view, taken approximately along the line 5—5, of FIG. 2 with portions omitted and showing selected parts overlying other parts.

The commutator valve 43 has a generally D-shaped recess 83 formed in the face 77 to a depth less than the depth of the recess 81. The D-shaped recess 83 defines the first fluid region 61. The commutator valve has a radially outer circumferential surface 72 spaced from a radially inner circumferential surface 73 of the plate 44. The surfaces 72, 73 partially define the second fluid region 96. A third fluid region 84 is defined by a modulation opening 84*a* in the commutator valve 43. The modulation opening 84*a* is approximately triangularly-shaped and is spaced radially apart from the D-shaped recess 83. The modulation opening 84*a* is shown in FIG. 5 located below the D-shaped recess 83.

Figure 4:
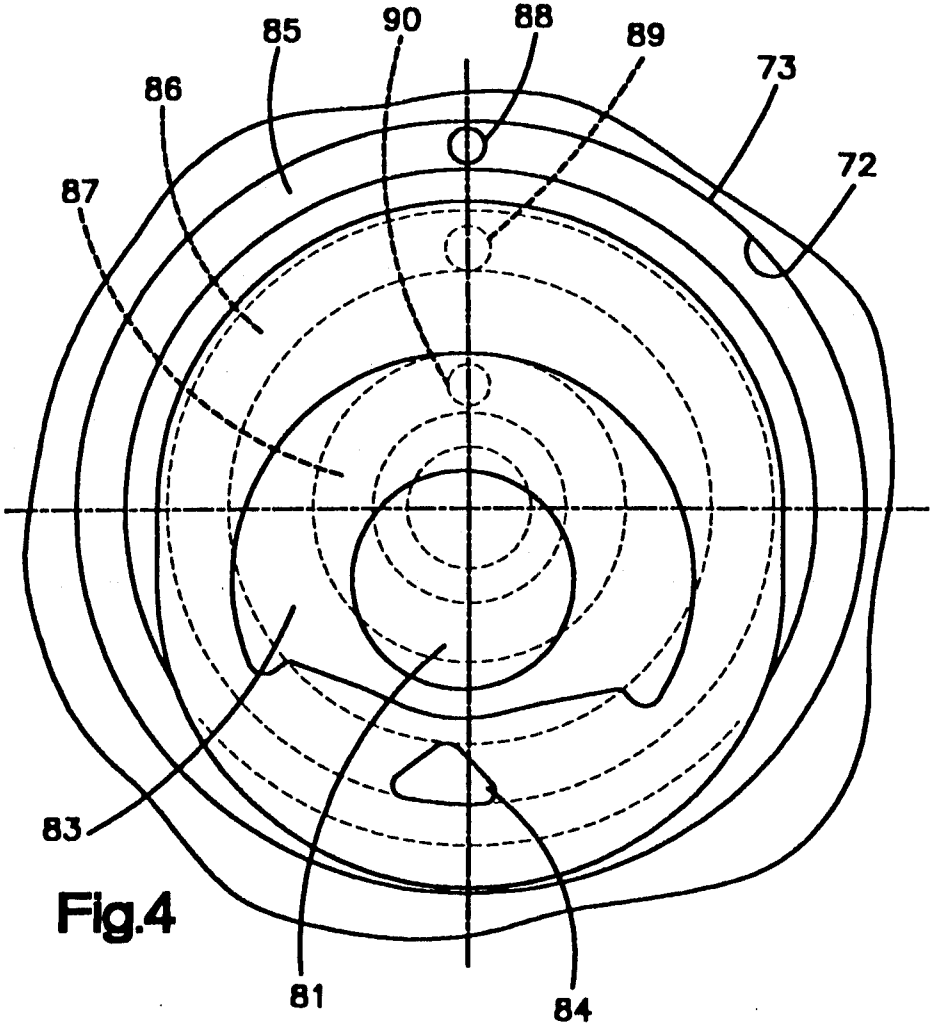
FIG. 4 is a partial view, taken approximately along the line 4—4, of FIG. 2.

Three annular grooves 85, 86, 87 are formed in the radial surface 76 of the end plate 46, as shown in FIG. 4. The annular groove 85 communicates with the second fluid region 96 which is at a relatively low fluid pressure. The annular groove 86 communicates through an opening 64 in the commutator valve 43 with the third fluid region 84, i.e. the modulation opening 84*a* in the commutator valve 43. The annular groove 87 communicates through an opening 40 in the commutator valve 43 with the first fluid region 61, i.e. the D-shaped recess 83 in the commutator valve 43.

Three fluid passages 88, 89, 90 extend axially into the end plate 46. A bore 91 extends radially into the end plate 46 and transversely to the three fluid passages 88, 89, and 90. The fluid passage 88 communicates the annular groove 85 and the bore 91. The fluid passage 88 is therefore connected in fluid communication with the low fluid pressure from the outlet port 35. The fluid passage 89 communicates the annular groove 86 and the bore 91. The fluid passage 89 is therefore connected in fluid communication with the modulation opening 84*a* in the commutator valve 43. The fluid passage 90 communicates the annular groove 87 and the bore 91. The fluid passage 90 is therefore connected in fluid communication with the high fluid pressure at the inlet port 34.

An axially movable two-position spool valve 92 is disposed within the bore 91 of the end plate 46. The spool valve 92 has a valve member 63 movable between two positions shown in FIGS. 2 and 6, respectively. The spool valve 92 may be manually operable in that the valve member 63 may be manually movable from one position to the other position. Also, the valve member 63 may be automatically movable from one position to the other position. For example, the valve member 63 may be automatically moved in response to pressurized fluid acting on the valve member 63 or in response to operation of a solenoid 65, as shown schematically in FIGS. 1 and 2.

The valve member 63 has a grooved portion 93 for connecting the two fluid passages 89, 90 in fluid communication with each other, and another grooved portion 94 for connecting the two fluid passages 88, 89 in fluid communication with each other. In one position of the valve member 63 (see FIG. 6), the fluid passage 89 is connected in fluid communication with the fluid passage 90. In the other position of the valve member 63 (see FIG. 2), the fluid passage 89 is connected in fluid communication with the fluid passage 88. The modulation opening 84*a* is connected in fluid communication with the high fluid pressure at the inlet port 34 when the valve member 63 is in the position shown in FIG. 6, and is connected in fluid communication with the low fluid pressure at the outlet port 35 when the valve member 63 is in the position shown in FIG. 2.

The first fluid region 61, i.e. the D-shaped recess 83, the third fluid region 84, i.e. the modulation opening 84*a*, and the second fluid region 96 are located and dimensioned relative to each other such that (i) three of the fluid pockets 30 are always in communication with the first fluid region 61, (ii) another three of the fluid pockets 30 are always in communication with the second fluid region 96, and (iii) one of the fluid pockets 30 is always in communication with the third fluid region 84, i.e. the modulation opening 84*a* in the commutator valve 43. Thus, either three or four of the fluid pockets 30 are in communication with high fluid pressure at any one time depending upon whether the modulation opening 84*a* is at high pressure or low pressure. Whether the modulation opening 84*a* is in communication with the high fluid pressure at the inlet port 34 or the low fluid pressure at the outlet port 35 depends upo the position of the valve member 63. Thus, the number of fluid pockets communicating with the high fluid pressure at the inlet port 34 and causing rotational and orbital movement of the rotor member 23 relative to the stator member 22 depends upon the position of the valve member 63.

During operation of the motor 10 with the valve member 63 in a first position, shown in FIGS. 1 and 2, the inlet port 34 is connected with the fixed displacement pump and the outlet port 35 is connected with low fluid pressure. The high pressure fluid from the inlet port 34 flows through the fluid passage 45, through the fluid chamber 13, through the bores 53, 54 in the drive sleeve 14, and then through the fluid passage 51 into the first fluid region 61. The fluid then flows from the first fluid region 61 through a certain number of the oval-shaped openings 97 in the second manifold plate 42 and into a corresponding certain number of the fluid pockets 30.

For purposes of explanation, the commutator valve 43 is shown in FIGS. 4 and 5 in a position in which the high pressure fluid from the first fluid region 61 flows into the three fluid pockets 30A, 30B, and 30D, i.e. the certain number of the fluid pockets 30. While the three fluid pockets 30A, 30B, and 30D are connected in fluid communication with the high pressure fluid in the first fluid region 61, the three fluid pockets 30E–30G are connected in fluid communication with the low fluid pressure in the second fluid region 96. Thus, as shown in FIGS. 3–5, the three oval-shaped openings 97A, 97B, and 97D, and hence the three fluid pockets 30A, 30B, and 30D, are connected in fluid communication with the high pressure fluid at the inlet port 34 while the three oval-shaped openings 97E–97G, and hence the three fluid pockets 30E–30G, are connected in fluid communication with the low fluid pressure at the outlet port 35.

Since the valve member 63 is in its first position shown in FIG. 2, the high pressure fluid also flows from the first fluid region 61, through the opening 40 in the commutator valve 43, through the annular groove 87, through the fluid passage 90, and into the grooved portion 93. The high pressure fluid is blocked from flowing to the fluid passage 89 and eventually to the modulation opening 84*a*, i.e. the third fluid region 84. As explained hereinabove, the modulation opening 84*a* communicates with the low fluid pressure at the outlet port 35 when the valve member 63 is in the first position as shown in FIG. 2. Thus, with the parts in the position shown in FIG. 5 for example, and the valve member 63 is in the position shown in FIG. 2, the fluid pocket 30C communicates with the modulation opening 84*a* which is at low fluid pressure at the outlet port 35.

Since the three fluid pockets 30A, 30B, and 30D are pressurized, the rotor 23 rotates and orbits relative to the stator 22. Since the one fluid pocket 30C, for example, is connected in fluid communication with the low fluid pressure at the outlet port 35, that fluid pocket 30C is effectively "shorted out". The result is that the rotor member 23 rotates and orbits at a relatively high speed relative to the stator member 22 and the motor 10 delivers a relatively low torque. This is due to the fact that the constant rate of fluid flow from the fixed displacement pump is flowing through three fluid pockets and not a greater number of fluid pockets. The operation of the motor 10 at this relatively high speed is known in the art as the high speed, low torque mode.

As the rotor member 23 rotates and orbits relative to the stator member 22, the wobble shaft 33 rotates the commutator valve 43. As the commutator valve 43 rotates, it continuously connects three of the fluid pockets 30 with high fluid pressure and three of the fluid pockets 30 with low fluid pressure. The modulation opening 84*a*, which remains at low fluid pressure, is always in communication with at least one of the fluid pockets 30. Thus, four fluid pockets are at low fluid pressure and three fluid pockets are at high fluid pressure during operation of the motor 10 with the valve member 63 in its first position as shown in FIG. 2.

Figure 6:
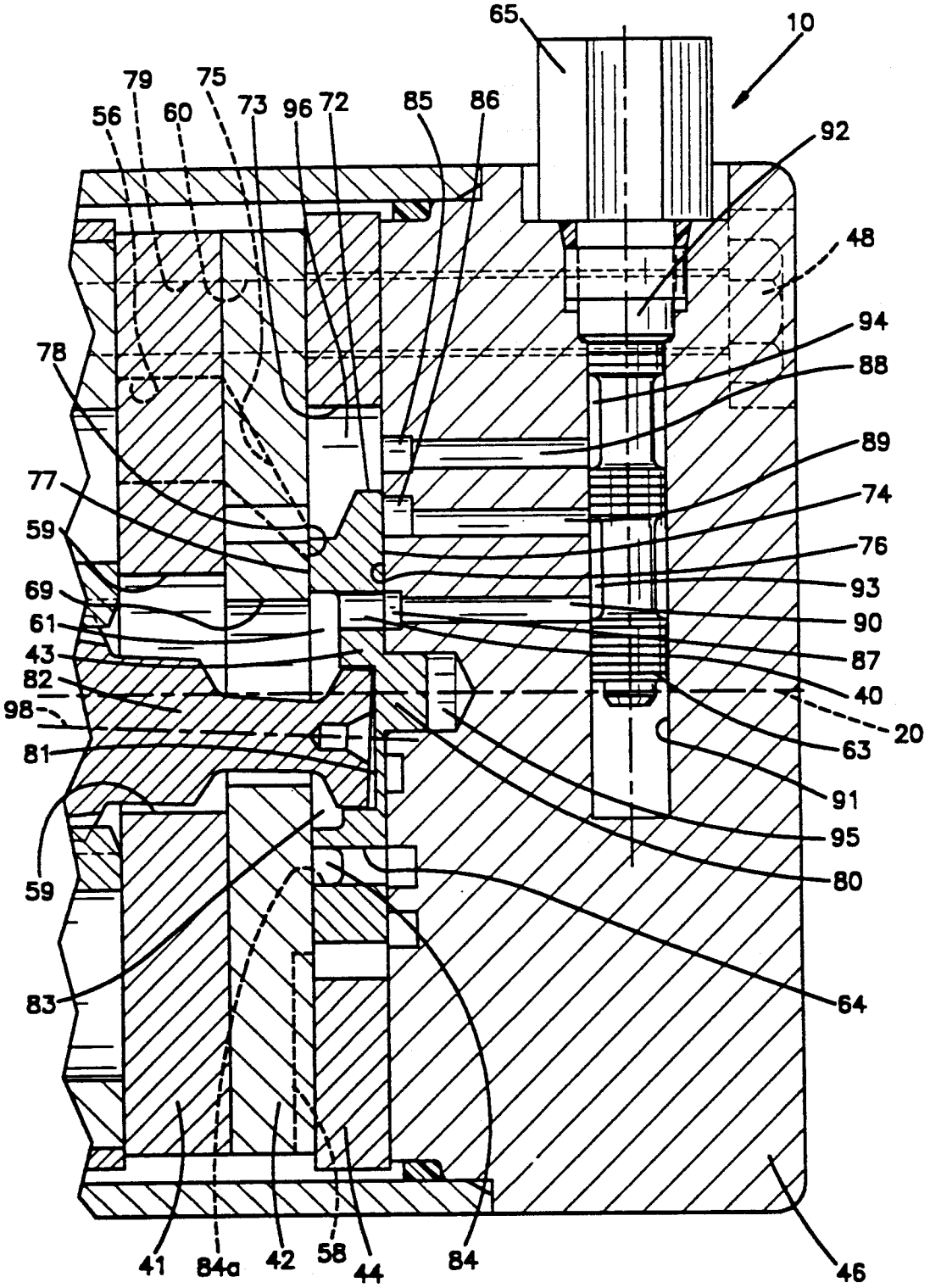
FIG. 6 is a view similar to FIG. 2 showing parts in a different position

During operation of the motor 10 with the valve member 63 in its second position as shown in FIG. 6, none of the four fluid pockets 30A–30D is "shorted out". None of the four fluid pockets 30A–30D is "shorted out" because the modulation opening 84*a* is connected in fluid communication through the fluid passage 89 and the fluid passage 90 to the high pressure fluid in the first fluid region 61 from the inlet port 34. Thus, with the parts in the position shown in FIG. 5, for example, and the valve member 63 is in the position shown in FIG. 6, the fluid pocket 30C communicates with the modulation opening 84*a* which is at the high pressure of the fluid at the inlet por 34. The result is that high pressure fluid is communicated to the four fluid pockets 30A-30D to cause rotational and orbital movement of the rotor member 23 relative to the stator member 22.

When the valve member 63 is in the second position as shown in FIG. 6 and the four fluid pockets 30A–30D are pressurized, the rotor member 23 rotates and orbits at a relatively low speed relative to the stator member 22 and the motor 10 delivers a relatively high torque. This is because the same constant rate of fluid flow from the fixed displacement pump is flowing through four fluid pockets and not three fluid pockets as previously described. Thus, the motor 10 operates at a relatively low speed to handle the same constant rate of flow from the fixed displacement pump. The operation of the motor 10 at this relatively low speed is known in the art as the low speed, high torque mode.

The modulation opening 84*a* remains at high fluid pressure as the commutator valve 43 rotates. Since the modulation opening 84*a* is always in communication with at least one of the fluid pockets 30 as the commutator valve 43 rotates, three fluid pockets are at low fluid pressure and four fluid pockets are at high fluid pressure during operation of the motor 10 with the valve member in its second position as shown in FIG. 6.

This invention has been described above with reference to a preferred embodiment. Modifications and changes may become apparent to one skilled in the art upon reading and understanding this specification. It is intended to cover all such modifications and changes within the scope of the appended claims.

Having described a preferred embodiment of the invention, the following is claimed:

1. A motor comprising:

a gerotor gearset including an inner gear member and an outer gear member, said gear members being rotatable and orbital relative to each other and defining expandable and contractible fluid pockets, said gear members rotating and orbiting relative to each other as said fluid pockets expand and contract;

a commutator valve movable with one of said gear members and at least partially defining a first region which communicates continuously with high pressure during expansion and contraction of said fluid pockets, a second region which communicates continuously with low pressure during expansion and contraction of said fluid pockets, and a third region which selectively communciates with high pressure or low pressure;

means for (i) communicating high pressure from said first region to a certain number of said fluid pockets, (ii) communicating low pressure from said second region to other of said fluid pockets, and (iii) communicating at least one fluid pocket with said third region; and valve means for controlling the speed of relative movement between said gear members, said vlave means including a valve member having a first position in which said third region communicates continuously with the low pressure from said second region during expansion and contraction of said fluid pockets and a second position in which said third region communicates continuously with the high pressure from said first region during expansion and contraction of said fluid pockets.

2. The motor of claim 1 wherein said third region is at least partially defined by an opening in said commutator valve.

3. The motor of claim 2 further including means defining a first fluid passage connected in fluid communication with said first region and means defining a second fluid passage connected in fluid communication with said second region.

4. The motor of claim 3 further including means defining a third fluid passage connected in fluid communication with said third region, said third fluid passage being connected in fluid communication with said first fluid passage when said valve member is in said second position, said third fluid passage being connected in fluid communication with said second fluid passage when said valve member is in said first position.

5. The motor of claim 4 further including means defining an annular groove connected in fluid communication between said third fluid passage and said opening in said commutator valve, said annular groove and said opening in said commutator valve being in continuous fluid communication as said commutator valve moves with said one of said gear members.

6. The motor of claim 5 further including an end plate having a bore extending therethrough, said valve member being disposed within said bore of said end plate, said first, second, and third fluid passages being located in said end plate and communicating with said bore.

7. A motor comprising:

a gerotor gearset including a stator with a number of internal teeth equal to N and a rotor with a number of external teeth equal to N−1, the teeth of the rotor and stator intermeshing and forming a number of expandable and contractible fluid pockets equal to N, the rotor having a central axis which is eccentric to the central axis of the stator, the rotor and the stator being rotatable and orbital relative to each other, the rotor and the stator rotating and orbiting relative to each other as the fluid pockets expand and contract;

an inlet port for connection to pressurized fluid and an outlet port for connection to fluid pressure lower than the pressure of the pressurized fluid;

a commutator valve movable with one of the gear members for directing pressurized fluid from the inlet port to a certain number of fluid pockets to expand same and for directing fluid flow from contracting fluid pockets to the outlet port, the commutator valve having an opening which communicates with at least one fluid pocket and selectively communicates with pressurized fluid from the inlet port or low fluid pressure from the outlet port;

passage means including a first fluid passage connected in fluid communication with the inlet port, a second fluid passage connected in fluid communication with the outlet port, and a third fluid passage connected in fluid communication with the opening the the commutator valve; and a spool valve including a valve member having at least two positions for controlling the speed of relative movement between the rotor and the stator, the valve member having a first position for connecting the third passage and the second passage in fluid communication with each other and thereby communicating the low fluid pressure from the outlet port through the opening to the at least one fluid pocket, the opening in the commutator valve communicating continuously with the low fluid pressure from the outlet port while the valve member is in the first position and the fluid pockets are expnding and contracting, the valve member having a second position for connecting the third passage and the first passage in fluid communication with each other and thereby communicating the pressurized fluid from the inlet port through the opening to the at least one fluid pocket, the opening in the commutator valve communicating continuously with the pressurized fluid from the inlet port while the valve member is in the second position and the fluid pockets are expanding and contracting.

8. The motor of claim 7 furhter including an end plate having a bore extending therethrough, the valve member being disposed within the bore of the end plate, the first, second, and third fluid passages being located in the end plate and communicating with the bore.

9. The motor of claim 8 wherein the first, second, and third fluid passges are disposed transversely to the bore.

10. The motor of claim 7 further including means defining an annular groove connected in continuous fluid communication between the third fluid passage and the opening in the commutator valve as the commutator moves with the one of the gear members.

* * * * *

UNITED STATES PATENT AND TRADEMARK OFFICE

CERTIFICATE OF CORRECTION

PATENT NO. : 5,061,160

DATED : October 29, 1991

INVENTOR(S) : Mark R. Kinder and Glenn R. Wert

It is certified that error appears in the above-identified patent and that said Letters Patent is hereby corrected as shown below:

Column 9, Line 15, Claim 1, change "communciates" to --communicates".

Line 24, change "vlave" to --valve--.

Column 10, Line 41, Claim 7, change "expnding" to --expanding--.

Col. 10, line 52, claim 8, change "furhter" to --further--.

Line 58, Claim 9, change "passges" to --passages--.

Signed and Sealed this

Ninth Day of March, 1993

*Attest:*

STEPHEN G. KUNIN

*Attesting Officer*

*Acting Commissioner of Patents and Trademarks*